US005188358A

United States Patent [19]

Glass

[11] Patent Number: 5,188,358

[45] Date of Patent: Feb. 23, 1993

[54] LAWN GAME MALLET

[76] Inventor: Philip E. Glass, 7207 Belding Rd., Rockford, Mich. 49341

[21] Appl. No.: 782,398

[22] Filed: Oct. 25, 1991

Related U.S. Application Data

[62] Division of Ser. No. 525,884, May 17, 1990, Pat. No. 5,060,956.

[51] Int. Cl.[5] ..... A63B 59/00

[52] U.S. Cl. ..... 273/67 R; 273/168; 273/175

[58] Field of Search ..... 273/67 R, 67 A, 56, 273/400, 411, 425, 72 R, 72 A, 167 R, 167 C, 167 D, 167 G, 168, 175, 67 C

[56] References Cited

U.S. PATENT DOCUMENTS

| | | | |
|---|---|---|---|
| 89,535 | 4/1869 | Wilson | 273/56 |
| 1,685,826 | 10/1928 | Radel | 273/168 |
| 2,009,252 | 7/1935 | Erickson | 273/425 X |
| 2,789,823 | 4/1957 | Bennett | 273/67 R X |
| 3,703,011 | 11/1972 | Goggi et al. | 273/67 R X |

*Primary Examiner*—Paul E. Shapiro
*Attorney, Agent, or Firm*—Varnum, Riddering, Schmidt & Howlett

[57] ABSTRACT

A mallet for use in a lawn game utilizing strikeable objects includes an upper end and an opposing lower end. A handle portion is disposed adjacent to the upper end, and a head portion is provided at the lower end. A shaft extends between the handle portion and the head portion. The head portion includes a bottom portion and an upper portion. The upper portion extends from the shaft portion to the bottom portion and flares outwardly and downwardly at an angle from the shaft portion to terminate at the bottom portion. The bottom portion is rounded in all directions and has a diameter which is substantially greater than the largest diameter of the shaft portion. The upper portion can comprise a circular cone shape to provide a continuous lateral surface for use in striking objects. Alternatively, the upper portion can comprise a pyramid shape to provide a plurality of lateral faces for use in striking objects.

9 Claims, 4 Drawing Sheets

LAWN GAME MALLET

This is a division, of application Ser. No. 525,884 filed May 17, 1990, now U.S. Pat. No. 5,060,956.

FIELD OF THE INVENTION

This invention relates generally to a lawn game mallet for use in striking objects, wherein the mallet includes a shaft and a bottom portion, the diameter of the bottom portion being substantially greater than the largest diameter of the shaft, and the bottom portion is rounded in all directions. In one of its aspects, the invention relates to a mallet having a circular cone shape portion adjacent to the bottom portion of the mallet to provide a continuous lateral surface for striking objects. In another of its aspects, the invention relates to a mallet having a pyramid shape portion adjacent to the bottom portion of the mallet to provide a plurality of lateral faces for striking objects.

DESCRIPTION OF THE RELATED ART

It is a typical purpose of lawn games to provide both adults and children with an entertaining and competitive game which can be played outdoors. More advanced games can also help to improve hand-eye coordination and provide exercise for the participants. Some games provide the participants with a color-coded scoring means, such as is disclosed in U.S. Pat. No. 3,820,789, and other games provide a predetermined course layout, such as that disclosed in U.S. Pat. No. 268,895, but heretofore no games have provided a color coded system for determining the layout of the course.

Other examples of game devices in the prior art may be found in U.S. Pat. Nos. 269,351, 1,111,554, 1,208,235, 1,548,068, 3,231,278, and 3,515,389.

SUMMARY OF THE INVENTION

This invention relates to a mallet for use in striking objects, wherein the mallet includes an upper end, a top portion at the upper end, and a handle portion adjacent to the top portion. A shaft portion extends from the handle portion to a head portion located at a lower end of the mallet. The head portion includes a bottom portion and an upper portion. The upper portion extends between the shaft portion and the bottom portion and flares outwardly and downwardly at an angle from the shaft portion to terminate at the bottom portion. The bottom portion is rounded in all directions and has a diameter which is substantially greater than the largest diameter of the shaft portion.

The upper portion can comprise a circular cone shape to provide a continuous lateral surface for use in striking objects. Alternatively, the upper portion can comprise a pyramid shape to provide a plurality of lateral faces for use in striking objects.

BRIEF DESCRIPTION OF THE DRAWINGS

The invention will now be described with reference to the drawings, in which.

DETAILED DESCRIPTION OF THE PREFERRED EMBODIMENTS

Figure 1:
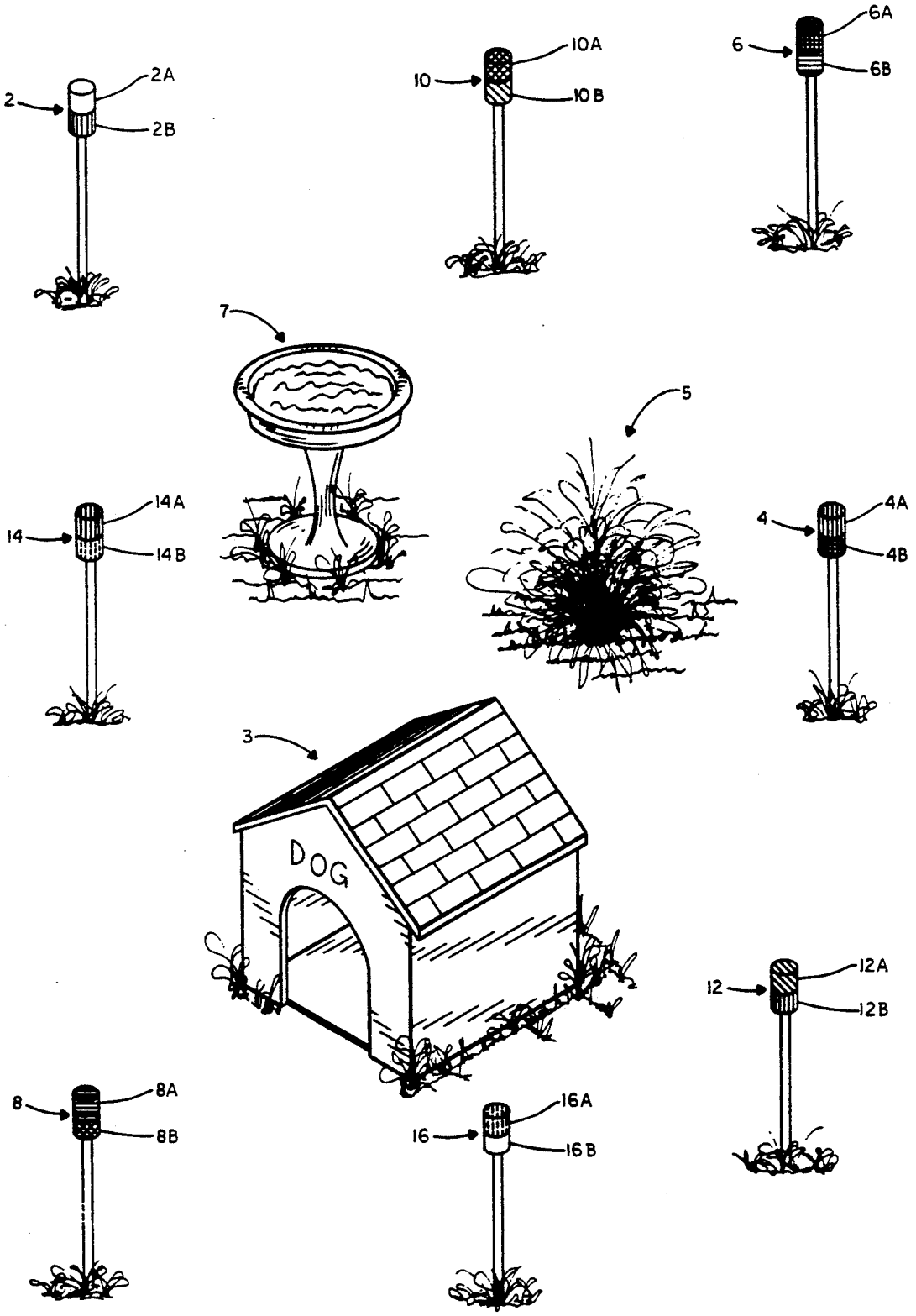
FIG. 1 is a perspective view of a typical course layout of a game according to the invention.

Turning now to the drawings, the implements of the game according to the invention consist of groups of three basic components, namely, target units, balls and mallets. In general, each player selects a ball and a mallet, an objective of the game being to drive the ball with the mallet to strike each target unit in a predetermined sequence, as explained more fully hereinbelow. The player to first "complete" the course may be declared the victor.

Each target unit 2, 4, 6, 8, 10, 12, 14, 16, includes a target 17, and a lower support 18 to which the target 17 is attached. These components are suitably made of any lightweight plastic or wooden material, although the particular material of construction forms no part of the invention's broader aspects. The target 17 is preferably of cylindrical shape, but could be a ball, cube or other geometrical figure, and is fastened to the lower support 18 by a suitable fastening means such as adhesive (not shown). Alternatively, though not shown specifically in the drawings, the target 17 could be in the form of a dual-colored flag or pennant.

Referring to the lower support 18 is a relatively solid, stakelike element, one end of which is suitable for a to the target 17, and the opposite end of which is tapered or pointed so that it may readily be driven into the grass or earth of a yard or park, or the sand of a beach. The target 17 is divided into two substantially equal halves, each half corresponding to its accompanying target unit. For instance, the target unit 2 is divided into an upper half 2A and a lower half 2B, the target unit 4 is divided into an upper half 4A and a lower half 4B, and so on. The individual halves of each target 17 are of different colors. Thus, in the case of target unit 2 for example, the upper half 2A is white and the lower half 2B is red.

It is an important aspect of the invention that the target units 2, 4, 6, 8, 10, 12, 14 and 16 provide a color-coded system which determines the course of the game. In FIG. 1, the target units 2, 4, 6, 8, 10, 12, 14 and 16 are arranged in a random fashion. Although the arrangement of the target units is random, the course layout or sequence in which the players are to strike the target units with a ball is determined by the color coding of the targets. For instance, the lower portion 2B of the target for target unit 2 being red, the next target unit in the layout sequence would be target unit 4, having a red upper portion 4A, and a yellow lower portion 4B. It can be seen that the sequence of the layout is determined by the colors on the targets of the target units, the color of the upper portion of one target unit target corresponding to the color of the lower portion of the preceding target unit target.

Similarly, the color of the lower portion of the one target unit target corresponds to the color of the upper portion of the next succeeding target unit target. Thus, the target unit 6 has a target 17 divided into a yellow upper portion 6A and a blue lower portion 6B, the yellow upper portion 6A corresponding to the yellow lower portion 4B of the target 17 for the target unit 4, such that the target unit 6 immediately follows the target unit 4 in the course layout sequence. Thus, the upper portion of each target provides first identification means (or identifying areas or indicia) for that target unit and the lower portion of each target provides second identification means.

Thus it can be seen that the progression of the game would be from target unit 2, to target unit 4, to target unit 6, and so on. The eight target units 2, 4, 6, 8, 10, 12, 14 and 16 shown in FIG. 1 are arranged to be followed in this manner. The layout of the course progresses from target unit 2 to target unit 4 to target unit 6, and so on, until target unit 16 is reached, at which point the objective of the game is to strike the start/finish target unit (target unit 2). The color of the lower portion of the target for target unit 16 corresponds to the color of the upper half 2A of the target unit 2. This progression is shown schematically in FIG. 2 in broken lines.

The second group of basic components of the game of this invention are durable, hollow, lightweight balls, each approximately three inches in diameter. An example of one of these balls is presented at 30 in FIG. 4. The balls are preferably formed of plastic and are made as perfectly spherical as possible to allow for optimum loft and distance. The various balls are driven against the target units 2, 4, 6, 8, 10, 12, 14 and 16 using the third group of basic components, namely the mallets 20. The balls 30 are color-coded to correspond to the respective mallets 20.

Figure 4:
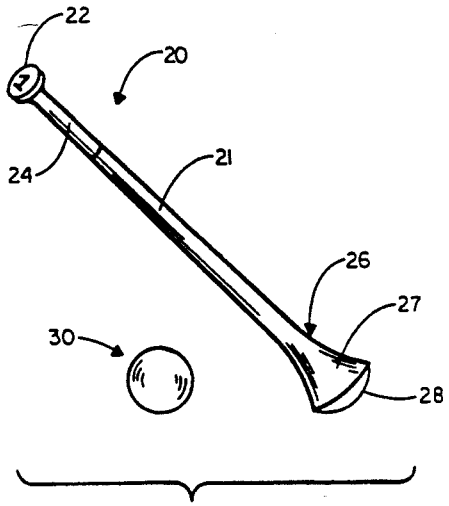
FIG. 4 is a perspective view of a mallet and a ball used in the game according to the invention.

One of the mallets 20, which are preferably made of a lightweight, durable, plastic, is illustrated in FIG. 4. A player who chooses to use a mallet 20 of a particular color would thereby choose the ball 30 of the corresponding color. Each mallet 20 is divided into four portions, a shaft portion 21, a top portion 22, a handle portion 24, and a head portion 26. In the preferred embodiment, the mallets are approximately thirty inches long, the handle portion 24 being approximately one inch in diameter at its uppermost point, and flaring out to approximately one and one-half inches at the bottom thereof. The shaft portion 21 is approximately one and one-half inches in diameter at the point where it meets the handle portion 24, and flaring out to approximately two inches at its bottom. The top portion 22 is approximately two inches in diameter.

As best shown in FIG. 4, the head portion 26 may include an upper portion 27 having a circular cone shape, an upper area of which has a diameter of approximately 1½ inches that flares outwardly to a diameter of approximately three inches at a lower area thereof. The lower area of the cone shaped upper portion 27 may be finished with a rounded bottom portion 28. The circular cone shaped upper portion 27 and the rounded bottom portion 28 enhance the difficulty of play because the contact of the rounded surfaces of the head portion 26 with the spherical ball 30 increases the likelihood that the ball will be driven in a direction different from that which was intended. The rounded bottom portion 28 offers less resistance as the mallet is swung through, for example, a grassy playing surface thereby reducing the likelihood of forming divots during the course of the game.

Figure 4A:
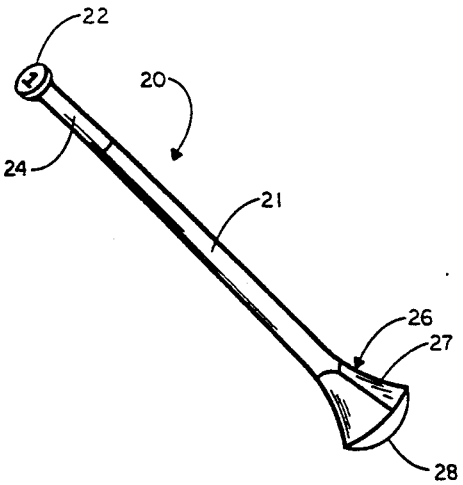
FIG. 4A is a perspective view of an alternative embodiment of a mallet used in the game according to the invention.

Alternatively, as best shown in FIG. 4A, the head portion 26 may include a pyramid shaped upper portion 27 that terminates in a rounded bottom portion 28 similar to that described hereinabove with reference to FIG. 4. Edges joining adjacent flat faces of the pyramid shaped upper portion 27 and edges joining the upper portion 27 to the rounded bottom portion 28 are preferably somewhat rounded so as to reduce the likelihood of injury if a player should be unintentionally struck by a mallet. The flat faces of the pyramid shaped upper portion 27 of FIG. 4A allow for greater lift and directional control of the ball 30 as compared to the circular cone shaped embodiment shown in FIG. 4. Both three- and four-sided pyramids are contemplated although only the formed is specifically shown in the drawings.

Furthermore, each top portion 22 may be inscribed or embossed with a numeral, such as the numeral 1 shown in FIG. 4. Preferably, each mallet is provided with a distinctive numeral that is different from that used to identify any other mallet in the game set. Preferably, the numerals progress arithmetically starting from one such that the final numeral utilized corresponds to the number of mallets in the game set. The numerals may be used to determine a player sequence. For example, a player selecting a mallet having the numeral I thereon would be the first player to proceed with the game whereas a player selecting a mallet having the numeral 2 thereon would be the second player to proceed and so on in an orderly manner.

In the preferred embodiment, the head portion 26 of the mallet is formed in such a way that when it strikes a ball 30, the head portion 26 causes the ball 30 to lift into the air. However the ball travels only a relatively small distance regardless of how hard a player strikes the ball because both the ball and the mallet are formed of, preferably, lightweight plastic. This lofting action increases the difficulty and the length of the game. The lofting action also increases parity among players since persons of all ages and physical ability will drive the ball approximately the same distance regardless of the force with which the ball is struck.

Figure 2:
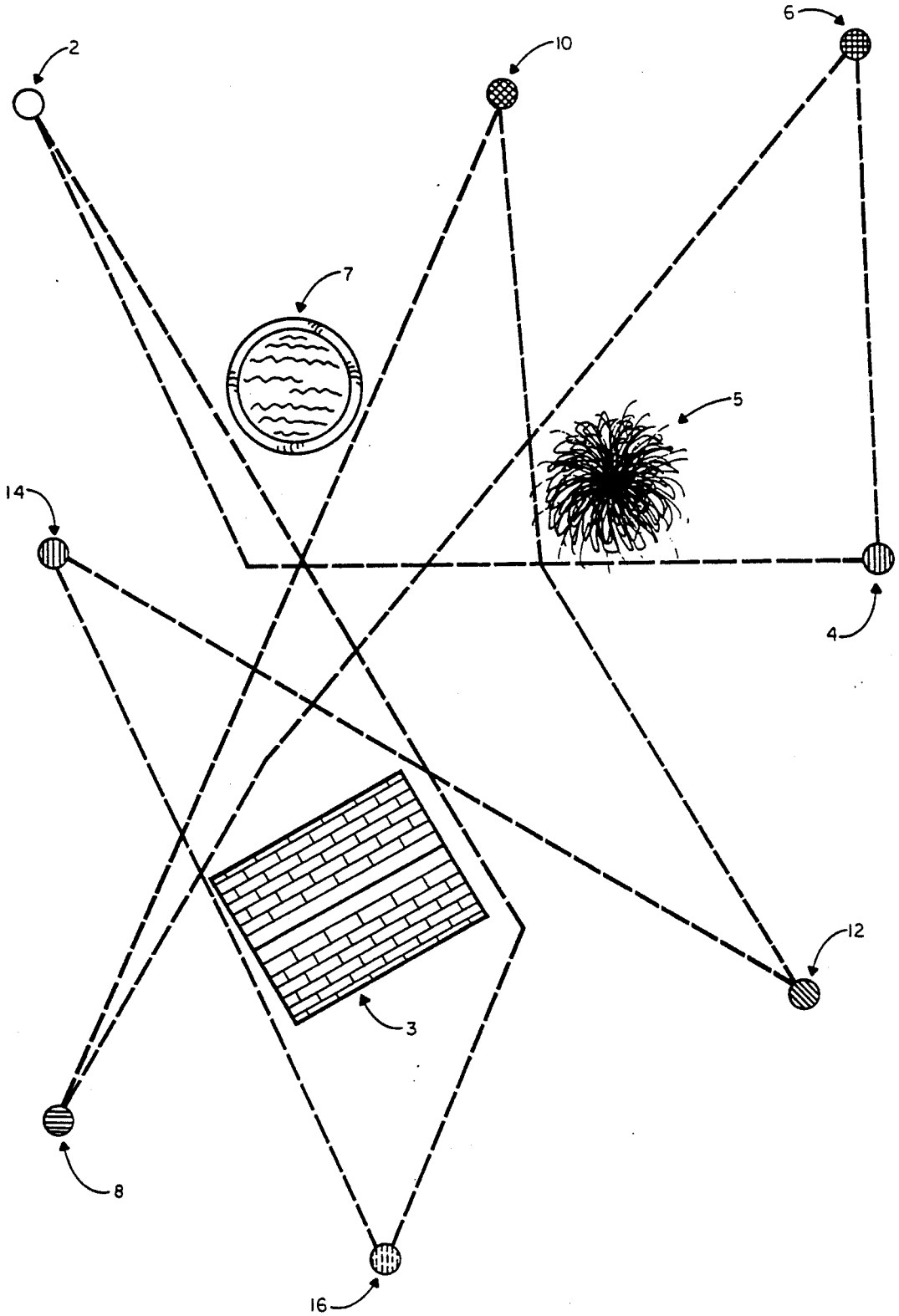
FIG. 2 is a top plan view of the layout of FIG. 1.
Figure 3:
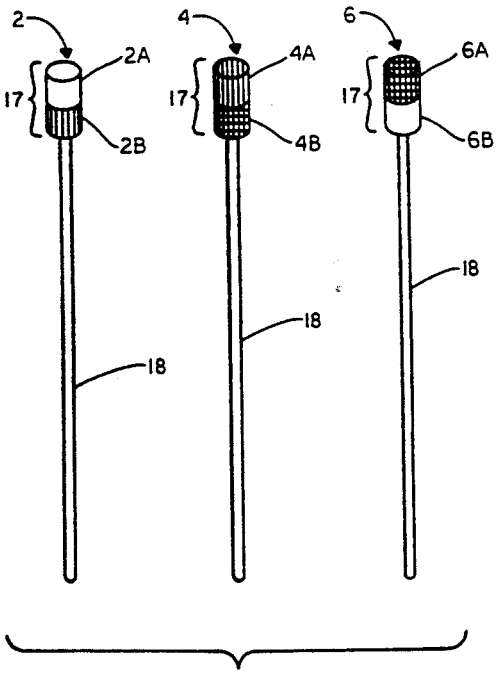
FIG. 3 is an elevational view of three of the target units employed in the game according to the invention.
Figure 5:
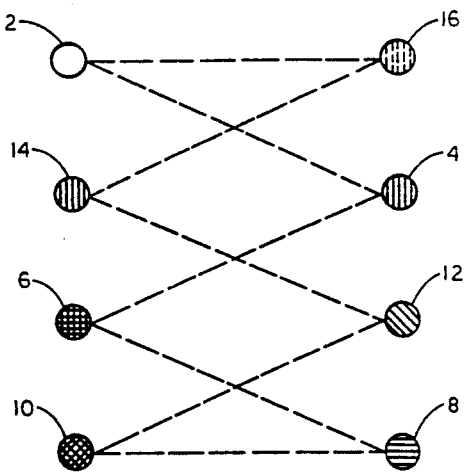
FIG. 5 is a top plan view of an alternative layout of the game course.

When used in the game of this invention, the target units 2, 4, 6, 8, 10, 12, 14 and 16 are arranged either in a random manner, as seen in FIGS. 1 and 2, or in a geometrically ordered manner, as seen in FIG. 5, about a suitable playing field, for instance a yard, a park or a beach. The choice to place the target units in a random or standard fashion is totally arbitrary and based upon the preference of the players as determined before the start of each game. The tapered ends 19 of the target units are driven into the earth or sand so that they stand upright. The land may be clear, or the natural topography of the land, such as hills, tall grass, and natural water obstacles may be used to make the game more difficult, and thereby enhance the quality of play. Both artificial and natural obstacles such as a doghouse 3, a shrub 5, and a birdbath 7, are pictured in FIGS. 1 and 2.

Any number of players may participate in a game, but the preferred number is two to six. To begin the game the players proceed to the target unit that is to serve as the predetermined start/finish point. In FIGS. 1, 2 and 5 the start/finish point is target unit 2. Although FIGS. 1, 2, and 5 show target unit 2 as the designated start/finish point, it will be understood that since the color-coded system which determines the course layout forms a closed loop of target units, any target unit may be chosen as the designated start/finish point at the beginning of each game. From the first target unit, the players, proceeding in a predetermined order, such order being facilitated by the provision of numbered mallets, drive their respective balls 30 with the corresponding mallets 20 toward the next appropriate target unit, the order of the target units being determined by color-coding, as explained above. Each player takes one stroke, and then allows the other participants their respective turns. The object of driving the balls 30 toward the target units is to strike the target units with the ball, and then proceed to the next target unit based upon the system of color-coding explained above. The player who first strikes all of the target units with his ball would be declared the winner. It should be emphasized that a player may strike any portion of the target unit including the target 17 and the lower support 18.

It is an added dimension of the game that if, while driving ball 30 with mallet 20, a player strikes an opponent's ball, the striking player may elect to take an additional two strokes toward the next target unit and/or another opponent's ball. Alternatively, may elect to "send" the struck ball away from the target units, thereby making it more difficult for his opponent to reach the target units, and then take one additional stroke toward the next target unit or another opponent's ball. If a player elects to take the two additional shots, he may place his ball one mallet length away from the struck ball in order to allow for clear swing at his own ball. Alternatively if a player elects to "send" the opponent's ball, he may place the opponent's ball one mallet's length away from his own ball, in order to allow for a clean, hard swing.

Figure 6:
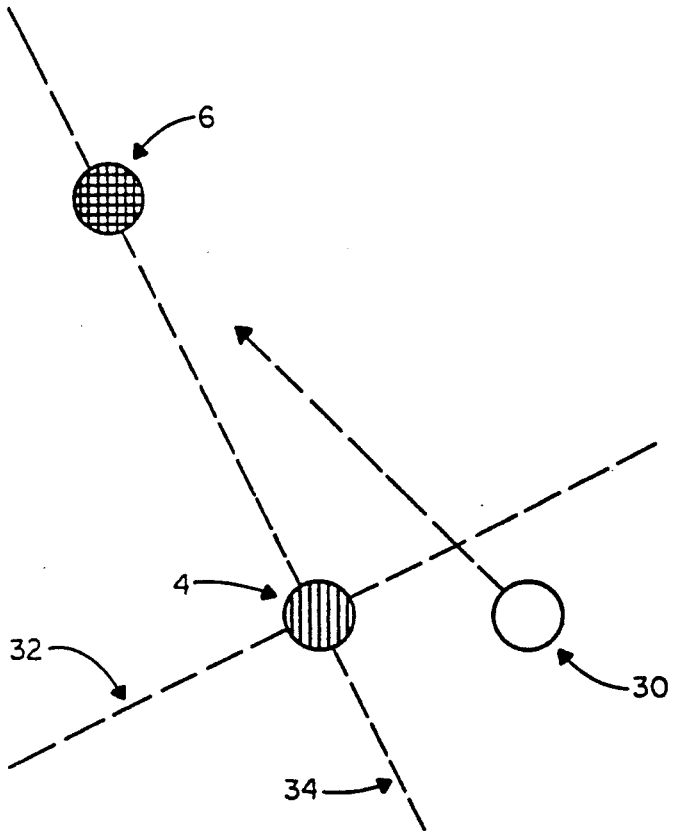
FIG. 6 is a schematic top plan view illustrating one of the rules of progression for the game in the preferred embodiment.

When a player strikes a target unit with his ball, he receives one extra shot toward the next target unit or another player's ball. More particularly, after hitting a target unit with his ball, the player may manually move his ball to any point to the rear of an imaginary straight line behind the hit target unit. This imaginary line is drawn perpendicular to another imaginary line that bisects the hit target unit, and the next target unit in the course layout progression. An example of the correct placement of a ball after striking a target unit is shown schematically in FIG. 6. Broken line 32 represents the imaginary line behind which the ball 30 must be placed after striking target unit 4. Broken line 34 represents the imaginary line which bisects target unit 4 and the next target unit in the progression, target unit 6. There is one exception to this rule, namely that the ball must be placed at least on mallet length away from any opponent's ball before the player proceeds with his shot.

There are a number of other possible rules for the game of this invention, including one or all of the following: If at any time one ball strikes any obstacle in the playing field, such as the doghouse 3, and then hits any opponent's ball, it is considered "legal," and the player may take the two extra strokes allowed to him by the rules above, or may elect to send the opponent's ball, and take only one extra stroke. Also, if a player's driven ball hits more than one opponent's ball, all of the struck balls may be "sent", and the player allowed one extra stroke. If a player's ball strikes a target unit and then an opponent's ball, or vice versa, this is a "double hit" and the player may choose from the options explained above. No extra shots may be accumulated by way of a combination of several ball hits. If a ball is in an unplayable lie, for example, under a bush or shrub, the ball may be manually moved by the player to a playable lie within one mallet length of the unplayable lie. Other rules based upon player preference may present themselves during the course of game play, and if players mutually agree to incorporate new rules, or eliminate one or more of the above rules, it may be done with no adverse affect on the game of the invention. These additional rules form no part of the game's broader aspects.

In this type of game, players are not only amused and entertained, but may benefit in various other ways. For instance, hand-eye coordination may be greatly enhanced by the process of driving the balls with the mallets, this being especially useful in developing the skills of children, skills which they may apply to other games, such as golf or tennis. Muscles are also developed by the swinging of the mallets, and the exercise provided by moving about the playing field. Children playing the game also learn to recognize and identify colors because of the colorful target units.

It should be apparent from the foregoing description of the preferred embodiment that the present invention provides a relatively simple and inexpensive yet entertaining game that is easily played by persons of all ages. The game structure requires a minimum of initial capital, and can be played at many outdoor areas, yet it is very durable and lightweight. All of these things make the game ideal for the whole family.

Obviously, any combination of colors could be used on the target units, as long as each target unit corresponds in color to the target units before and after it in the course layout sequence. Also, any variety of differently shaped targets or flags may be substituted for the targets 17, as long as each target is divided into different colored halves.

The following invention has been described in connection with the preferred embodiments, and it will be understood that this description is intended to illustrate, and not limit the scope of the invention which is defined by the following claims.

The exclusive embodiments for which an exclusive property or privileges is claimed are defined as follows:

1. A mallet for use in striking objects, the mallet comprising an upper end and an opposing lower end, a top portion at said upper end, a handle portion adjacent to said top portion, a head portion at said lower end, and a shaft portion extending between said handle portion and said head portion, said head portion comprising a bottom portion and a striking portion, said striking portion extending between said shaft portion and said bottom portion and flaring outwardly and downwardly at an angle from said shaft portion to terminate at said bottom portion, whereby the diameter of said bottom portion is substantially greater than the largest diameter of said shaft portion, said bottom portion being rounded in all directions, and said striking portion comprises a pyramid shape to provide a plurality of lateral faces for striking objects.

2. A mallet according to claim 1 wherein each of said lateral faces is continuously concave.

3. An elongate mallet for use in striking objects, comprising an upper end and an opposing lower end, a handle portion at the upper end, a head portion at the lower end, and a shaft portion extending between the handle portion and the head portion, the head portion occupying less than one-fourth of the length of the mallet and having a bottom surface and a striking surface flaring downwardly and progressively outwardly from the shaft portion to intersect the bottom surface in an outer edge circumscribing the head portion at the widest transverse extent of the mallet.

4. A mallet according to claim 3, wherein the bottom surface extends convexly downwardly from the outer edge.

5. A mallet according to claim 3, wherein the striking surface is transversely circular and continuously outwardly concave in the longitudinal direction of the mallet.

6. A mallet according to claim 3, wherein the bottom surface extends convexly downwardly from the outer edge, and the striking surface is transversely circular and continuously outwardly concave in the longitudinal direction of the mallet, whereby the outer edge is annular and marks an abrupt discontinuity in the lateral profile of the mallet.

7. A mallet according to claim 3, wherein the striking surface is pyramidal in shape to provide a plurality of lateral faces for striking objects.

8. A mallet according to claim 7, wherein each of the lateral faces is continuously outwardly concave in the longitudinal direction of the mallet.

9. A mallet according to claim 8, wherein the bottom surface extends convexly downwardly from the outer edge, whereby the outer edge defines a polygon and marks an abrupt discontinuity in the lateral profile of the mallet.

* * * * *